United States Patent [19]

Livingston

[11] Patent Number: 4,696,116

[45] Date of Patent: Sep. 29, 1987

[54] MOUNTING STRUCTURE FOR ROTARY DRUM DRYER

[75] Inventor: Andrew D. Livingston, Independence, Kans.

[73] Assignee: Guaranty Performance Co., Inc., Independence, Kans.

[21] Appl. No.: 877,531

[22] Filed: Jun. 23, 1986

[51] Int. Cl.[4] ..... F26B 25/02

[52] U.S. Cl. ..... 34/108; 34/130; 432/103; 384/549

[58] Field of Search ..... 34/108, 130, 133, 135, 34/140, 141, 142; 432/103, 108, 118; 384/58, 416, 549, 590

[56] References Cited

U.S. PATENT DOCUMENTS

| | | | |
|---|---|---|---|
| 2,707,339 | 5/1955 | Berge | 34/130 |
| 2,783,548 | 3/1957 | Halldorsson | 34/130 |
| 2,819,130 | 1/1958 | Kaminsky | 432/103 |
| 2,908,179 | 10/1959 | Taylor | 432/103 |
| 3,561,132 | 2/1971 | LaGrone | 34/108 |
| 3,648,992 | 3/1972 | Durinck et al. | 432/103 |
| 4,523,387 | 6/1985 | Mahan | 34/133 |
| 4,624,576 | 11/1986 | Dillman | 432/103 |

*Primary Examiner*—Albert J. Makay
*Assistant Examiner*—David W. Westphal
*Attorney, Agent, or Firm*—Schmidt, Johnson, Hovey & Williams

[57] ABSTRACT

A mounting structure for use in rotationally supporting a rotatable drum dryer is provided which prevents spauling, flaking and pitting of the dryer tracks, which supports the rotational movement of the dryer, and which prevents axial shifting of the dryer. The mounting structure preferably includes a fixed base, at least a pair of proximal, continuous, annular tracks fixedly secured to the dryer, and a corresponding pair of trunnion rollers rotatably coupled with the base and adapted for contacting the faces of the tracks respectively. The mounting structure also advantageously includes at least one thrust wheel for engaging the side of one of the tracks to prevent axial shifting of the dryer. More particularly, two mounting structures are provided, one for each end of the dryer, and each mounting structure includes two pairs of thrust wheels, one pair engaging the side of each track and opposedly configured to prevent axial shifting of the dryer in either direction.

4 Claims, 3 Drawing Figures

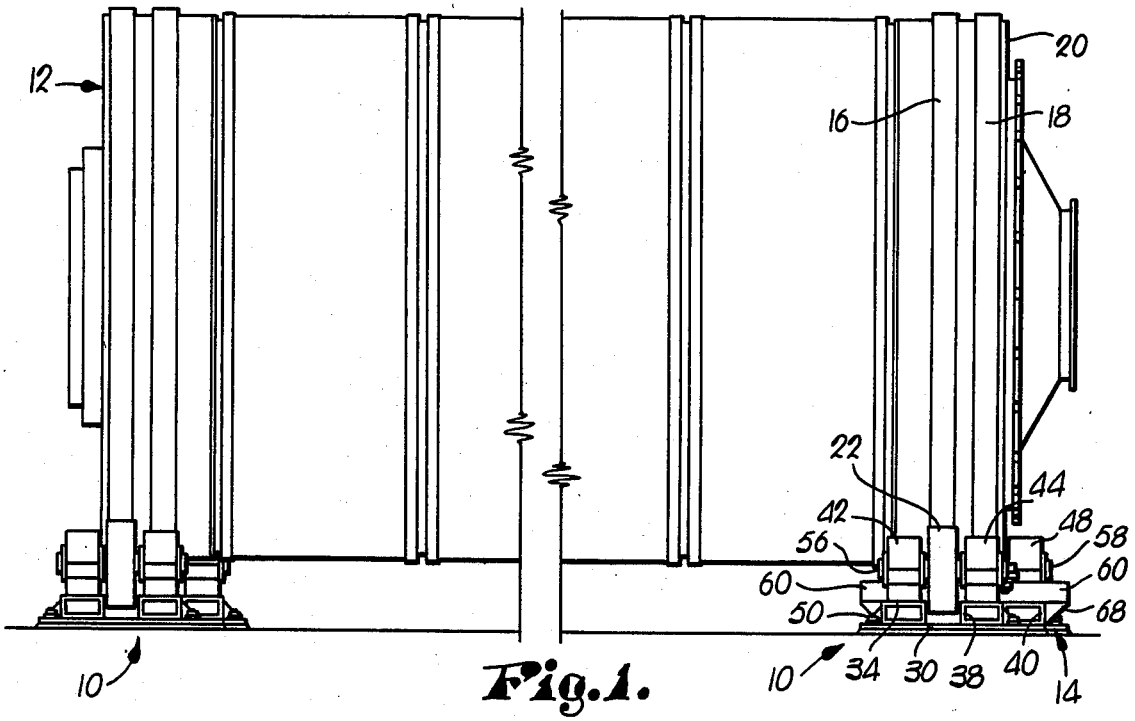
Fig.1.
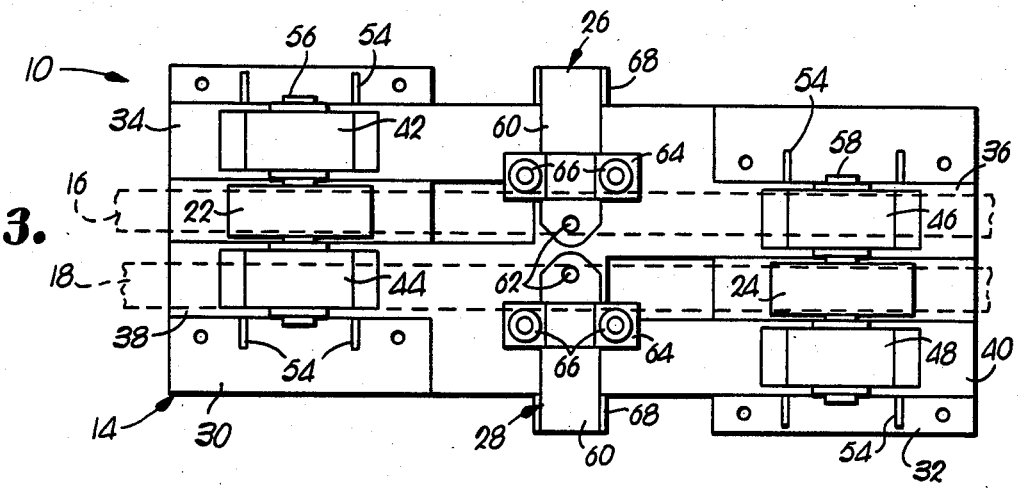
Fig.3.
Fig.2.
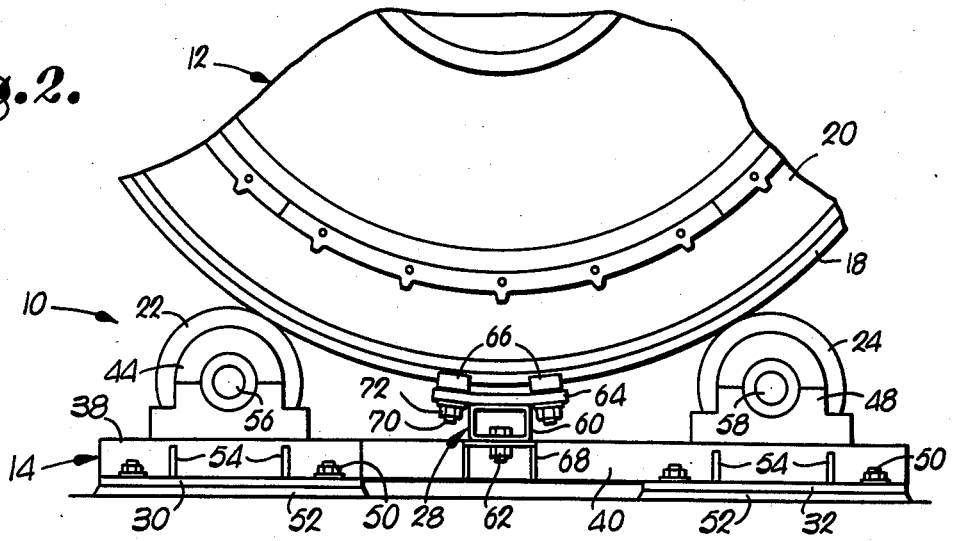

MOUNTING STRUCTURE FOR ROTARY DRUM DRYER

BACKGROUND OF THE INVENTION

1. Field of the Invention

This invention relates to a mounting structure for a rotary drum dryer having annular rotation tracks which prevents spauling, flaking and pitting of the annular tracks when supported by rotating trunnion rollers. More particularly, this invention relates to a mouting structure in which each track rides on its own individual trunnion roller and which also includes thrust wheels for preventing axial movement of the dryer during rotation thereof.

2. Description of the Prior Art

Known prior art mounting structures for rotary drum dryers typically include a continuous annular track near each end thereof supported by a pair of trunnion rollers in supportive contact with the face of the track. The trunnion rollers are spaced apart so that the track and dryer are cradled therein.

Rotary drum dryers are typically very large and heavy, especially so when loaded with material to be dried such as soybean meal. Typically, the material enters one end of the dryer and is conveyed to the other end for exit by internal flights and sweeps which tumble and agitate the material as well as convey it gradually toward the outlet end. Because of the extreme weight of these dryers, each single track supports half the total weight of the dryer. The weight supported by each track is transmitted to the two points where the track contacts the two trunnion wheels associated therewith.

During installation of a rotary drum dryer, installers endeavor to axially align the trunnion rollers with one another and with the axis of the dryer. It is not practical, or indeed possible, to perfectly align all three axes. As a result, each trunnion roller exhibits a slightly different wear pattern on the face of the track. These different wear patterns often cause opposed flexing on the face of the track which results in spauling, flaking, and pitting of the track face.

SUMMARY OF THE INVENTION

The problems outlined above are solved by the mounting structure in accordance with the present invention. That is to say, the mounting structure hereof prevents spauling, flaking, and pitting of a rotary drum dryer track.

Broadly speaking, the mounting structure for use in rotationally supporting a horizontally disposed rotary drum dryer comprises a fixed base, a pair of proximal, continuous, annular tracks fixedly secured to the dryer, and a corresponding pair of trunnion rollers rotatably coupled with the base and adapted for contacting the face of each track respectively to thereby rotatably support the track and the dryer; the roller are located respectively on opposed sides of the dryer.

Preferably, two pairs of tracks are provided for the dryer, one pair at each end thereof, with a trunnion roller associated with each track and the axes of the trunnion rollers parallel to the axis of the dryer. The mounting structure advantageously includes a pair of pivotally mounted thrust wheels associated with each track for engaging the sides of the track to prevent axial shifting of the dryer—one pair of thrust wheels being in contact with one side of one track to prevent axial shifting of the dryer in one direction and another pair of thrust wheels being in contact with an opposed side of the other track to prevent axial shifting of the dryer in the other direction.

BRIEF DESCRIPTION OF THE DRAWINGS

FIG. 1 is a partial elevational view of a rotary drum dryer showing respective ends thereof supported by the mounting structure;

FIG. 2 is a partial end view of the mounting structure; and

FIG. 3 is a plan view of the mounting structure showing a pair of tracks in phantom lines.

DESCRIPTION OF THE PREFERRED EMBODIMENT

Referring now to the drawings, a mounting structure 10 for use in rotationally supporting a substantially axially horizontal, cylindrical, rotatable drum dryer 12 broadly includes base 14, a pair of continuous annular tracks 16 and 18 fixedly mounted near one end 20 of dryer 12, rotatable trunnion rollers 22 and 24, and two thrust wheel assemblies 26 and 28.

Base 14 includes steel base plates 30 and 32, tubular beams 34, 36, 38, and 40, and conventional split pillow block ball bearings 42, 44, 46, and 48.

Plates 30, 32 are spaced apart and preferably fixed to a concrete foundation (not shown) by appropriate conventional anchors 50 as shown. Grout 52 fills the gap between plates 30, 32 and the concrete foundation (FIG. 2).

Tubular beam 34 extends across plate 30 to the inboard edge of plate 32; a pair of gussets 54 provide additional support between beam 34 and plate 30. Tubular beam 36, adjacent beam 34, extends across plate 32 to the inboard edge of plate 30 and is additionally supported to plate 32 by a pair of gussets 54. Tubular beam 38, adjacent beam 36, extends across plate 30 to the inboard edge of plate 32 and is additionally supported to plate 30 by a pair of gussets 54. Beams 36 and 38 narrow near the center line between plates 30, 32 as shown in FIG. 2. Tubular beam 40, adjacent beam 38, extends across plate 32 to the inboard edge of plate 30 and is additionally supported to plate 32 by a pair of gussets 43. Beam 34–40 and gussets 54 are welded to plates 30,32.

Axially aligned bearings 42 and 44 are mounted to beams 34 and 38 respectively along the center line of plate 30. Axially aligned bearings 46 and 48 are mounted to beams 36 and 40 respectively along the center line of plate 32.

Trunnion roller 22 includes rotation shaft 56 extending therethrough, the ends of which are received in bearings 42 and 44 respectively so that trunnion roller 22 is rotationally mounted between bearings 42, 44. Similarly, trunnion roller 24 includes rotation shaft 58, the ends of which are received in bearings 46 and 48 respectively so that roller 24 is rotationally mounted thereto. Note that rollers 22 and 24 are laterally offset as shown in FIG. 3.

Spaced-apart tracks 16 and 18 are fixedly mounted near end 20 to dryer 12 and aligned with rollers 22 and 24 respectively. With this configuration, dryer 12 is received in a "cradle" formed by rollers 22, 24 with track 16 having one point of contact with roller 22 and track 18 having one point of contact with roller 24. With this configuration, end 20 of dryer 12 is thus rotatably supported by rollers 22 and 24.

Thrust wheels assemblies 26 and 28, each include a support beam 60, a pivot 62, a cross arm 64, two thrust wheels 66, and a support beam extension 68. Nut and bolt pivot 62 connects the inboard end of support beam 60 to tubular beam 38 through aligned holes (not shown) along the center line of base 14. Support extension 68 is welded to tubular beam 40 and slidably supports the outboard end of support beam 60.

Cross arm extends laterally across the top of support beam 60 and is welded thereto.

Thrust wheels 66 each include a threaded shaft 70 which is received through an appropriate hole (not shown) through cross bar 64 and secured thereto by nut 72.

Thrust wheels 66 of thrust wheel assembly 26 engage the inboard side of track 16. Thrust wheels 66 of thrust wheel assembly 28 engage the outboard side of track 18 (FIG. 2).

An advantageous application of the present invention includes the use of two mounting structures 10 at each end of a dryer 12 is illustrated in FIG. 1. In this preferred use, dryer 12 is rotatably supported at two points of contact at each respective end, the points of contact being where the faces of tracks 16 and 18 contact trunnion rollers 22 and 24 respectively.

In operation, an appropriate conventional drive (not shown) rotates drum dryer 12. Trunnion rollers 22 and 24, while supporting dryer 12, also rotate. Because each roller 22, 24 supports its own respective track 16, 18, each roller-track pair forms its own wear pattern. This avoids spauling, flaking, and pitting because the wear pattern is uniform and is not counterstressed in some other direction by a second roller in contact with that track. As a result, each roller-track pair will wear in together so that total face-to-face contact is maintained. In this way, the life of the rollers and the tracks is greatly extended saving both repair and downtime expense.

Thrust wheel assemblies 26, 28 operate to prevent dryer 12 from moving axially left or right. Thrust wheels 66 of thrust wheel assembly 28 rotate as dryer 12 rotates. Axial movement of dryer 12 to the right, as viewed in FIG. 1, is prevented by wheels 66 contacting the outboard edge of track 18. The pivotal freedom of thrust wheel assembly 28 about pivot 62 ensures that both thrust wheel 66 exert equal force on track 18. Because the wheels 66 are on opposed sides of the center plane of dryer 12, wheels 66 also aid in keeping dryer 12 laterally aligned. Thrust wheel assembly 26 performed a similar function to prevent leftward axial shifting of dryer 12 by contacting the inboard edge of track 16. With two mounting structures used on dryer 12, proper alignment of dryer 12 is doubly assured.

Having thus described in detail the preferred embodiment of the invention, what is claimed as new and desired to be secured by Letters Patent is:

1. Mounting structure for use in rotationally supporting an elongated, substantially horizontally oriented, cylindrical body having a vertical plane of symmetry through the rotational axis thereof, said mounting structure comprising:

first and second proximal, juxtaposed, continuous annular tracks fixedly secured to said body, said tracks each presenting an outer engagement face;

first track support means contacting said first track face on a first side of said vertical plane for rotatably supporting said first track, said first support means being the sole rotational support for said first track; and second track support means contacting said second track face on a second opposed side of said vertical plane for rotatably supporting said second track, said second support means being the sole means of rotational support for said second track.

2. The mounting structure as set forth in claim 1, said first and second track support means comprising respective first and second rollers, said rollers being axially parallel to one another and to said body.

3. The mounting structure as set forth in claim 1, including a fixed base, said first and second support means each including a respective pinnion roller rotatably coupled with said base.

4. The mounting structure as set forth in claim 1, said body.comprising a dryer drum.

* * * * *